US006305534B1

(12) United States Patent
Neal

(10) Patent No.: US 6,305,534 B1
(45) Date of Patent: Oct. 23, 2001

(54) AUTOMATIC QUIVER

(76) Inventor: Frank A. Neal, 953 Apple Valley Rd., Lyons, CO (US) 80540

( * ) Notice: Subject to any disclaimer, the term of this patent is extended or adjusted under 35 U.S.C. 154(b) by 0 days.

(21) Appl. No.: 09/453,449

(22) Filed: Dec. 3, 1999

(51) Int. Cl.[7] ..... B65D 85/00
(52) U.S. Cl. ..... 206/315.11; 211/70; 211/78
(58) Field of Search ..... 206/315.1, 315.11, 206/443, 579; 224/916; 211/70, 74, 78, 84, 70.2; D3/254, 262; 24/25.5, 25.7, 41.1, 44.5, 86, 88; 473/578

(56) References Cited

U.S. PATENT DOCUMENTS

| | | | | |
|---|---|---|---|---|
| D. 343,954 | | 2/1994 | Simmons . | |
| 2,956,603 | * | 10/1960 | Maule | 124/25.5 |
| 2,984,277 | * | 6/1961 | Neff | 124/25.5 |
| 3,337,099 | * | 8/1967 | Rose | 124/25.7 |
| 3,601,113 | | 8/1971 | Wilkie . | |
| 4,628,628 | * | 12/1986 | Burgin et al. | 206/315.11 |
| 5,137,319 | * | 8/1992 | Sander | 206/315.11 |
| 5,190,022 | * | 3/1993 | Larson | 124/25.7 |
| 5,690,088 | | 11/1997 | Ruble . | |
| 5,775,314 | * | 7/1998 | Michael et al. | 124/86 |

* cited by examiner

*Primary Examiner*—Shzan Luong
(74) *Attorney, Agent, or Firm*—Armstrong, Westerman, Hattori, McLeland & Naughton, LLP

(57) ABSTRACT

The present invention is a quiver having: a housing having a top end an a bottom end and an opening between the top and bottom ends for the insertion and removal of arrows and a carousel mounted inside the quiver for the positioning and delivery of arrows. The carousel of the quiver of the present invention has a rotatable shaft in the center of the housing, at least one means attached to the rotatable shaft for gripping arrows, a shaft mount associated with the top half the housing for mounting the shaft, and at least one spring for biasing the rotatable shaft, with the spring being associated at one end with the housing and at the opposite end with the rotatable shaft. In use the carousel is positioned and arranged to automatically bring arrows to a position adjacent the opening between the top and bottom ends of the housing for removal from the quiver.

12 Claims, 7 Drawing Sheets

AUTOMATIC QUIVER

FIELD OF INVENTION

This invention relates to relates to quivers for the archer and bow hunter. More particularly this invention relates to automatic quivers.

BACKGROUND OF THE INVENTION

Bow hunting has become an increasingly popular and competitive sport. As a result there is a demand for better equipment. A good quiver is as important to the serious bow hunter as the bow itself. Protecting arrows is no longer the only function of a good quiver. A quiver must also be light-weight, durable, capable of storing each arrow to prevent damage to the fletched end, and a quiver must be designed for the quiet and efficient removal of arrows while game hunting.

Generally, arrows have a long straight shaft, a pointed tip at one end and fins made of feathers at the opposite end, called the fletched end. The feathers affect the flight path of the arrow. They are delicate and can be easily bent, separated or crushed. Additionally, exposure to foul weather and precipitation such as rain, sleet and snow can cause the feathers to become matted down making the arrow unusable.

The traditional sleeve-shaped quiver for arrows did not prevent damage to the arrows caused by jostling of the arrows inside the quiver. Newer quivers have been designed to protect the arrows from contact damage by securing the arrows independently of each other at both the point and fletched ends. However, these quivers are open at the top and leave the arrows exposed to the environment. Standard quivers do nothing to protect the arrows from the elements or damage occurring during normal use.

Rotating enclosed quivers have been proposed as in U.S. Pat. No. 5,690,088 to Ruble (1997). The disclosed quiver has a rotator lid which is manually turned to position arrows inside the quiver. However, to be of practical use to a hunter, a back worn quiver must be a "hands-free" design so that it does not distract the hunter while hunting and shooting.

Thus, there is a need for a quiver which can protect the arrows from damage inside the quiver, shield the arrows from foul weather, and position and deliver arrows for use automatically without any distraction to the archer or hunter.

SUMMARY OF THE INVENTION

The present invention is a quiver having: a housing having a top end an a bottom end and an opening between the top and bottom ends for the insertion and removal of arrows and a carousel mounted inside the quiver for the positioning and delivery of arrows. The carousel of the quiver of the present invention has a rotatable shaft in the center of the housing, at least one means attached to the rotatable shaft for gripping arrows, a shaft mount associated with the top half the housing for mounting the shaft, and at least one spring for biasing the rotatable shaft, with the spring being associated at one end with the housing and at the opposite end with the rotatable shaft.

In use the carousel is positioned and arranged to automatically bring arrows to a position adjacent the opening between the top and bottom ends of the housing for removal from the quiver.

OBJECTS OF THE INVENTION

It is an object of the present invention to provide a back-worn quiver which can protect arrows from weather and physical damage.

It is another object of the present invention to provide a lightweight back-worn quiver which has a rigid outer covering that encloses and protects the arrows.

It is still yet another object of the present invention to provide a back-worn quiver with a side opening for inserting and removing arrows.

It is a further object of the present invention to provide a back-worn quiver that automatically positions and delivers arrows.

Other objects, features and advantages of the present invention will become apparent from the following detailed description taken in conjunction with the accompanying drawings.

DETAILED DESCRIPTION OF THE INVENTION

The quiver of the present invention comprises a housing and an independently rotatable carousel mounted inside the housing. The housing generally encloses the carousel and provides an opening along the length of the housing for the insertion and removal of arrows. The carousel is a rotatable device, like a rotatable magazine, which holds arrows upright. While the carousel of the present invention may be free spinning, the preferred carousel advances automatically upon the removal of each arrow from the quiver. The quiver, having a capacity to hold as many as eight or ten arrows and suitable for carrying on the back of a hunter during game hunting, can automatically position arrows adjacent the opening along the length of the quiver for easy, efficient and quiet removal.

Figure 1:
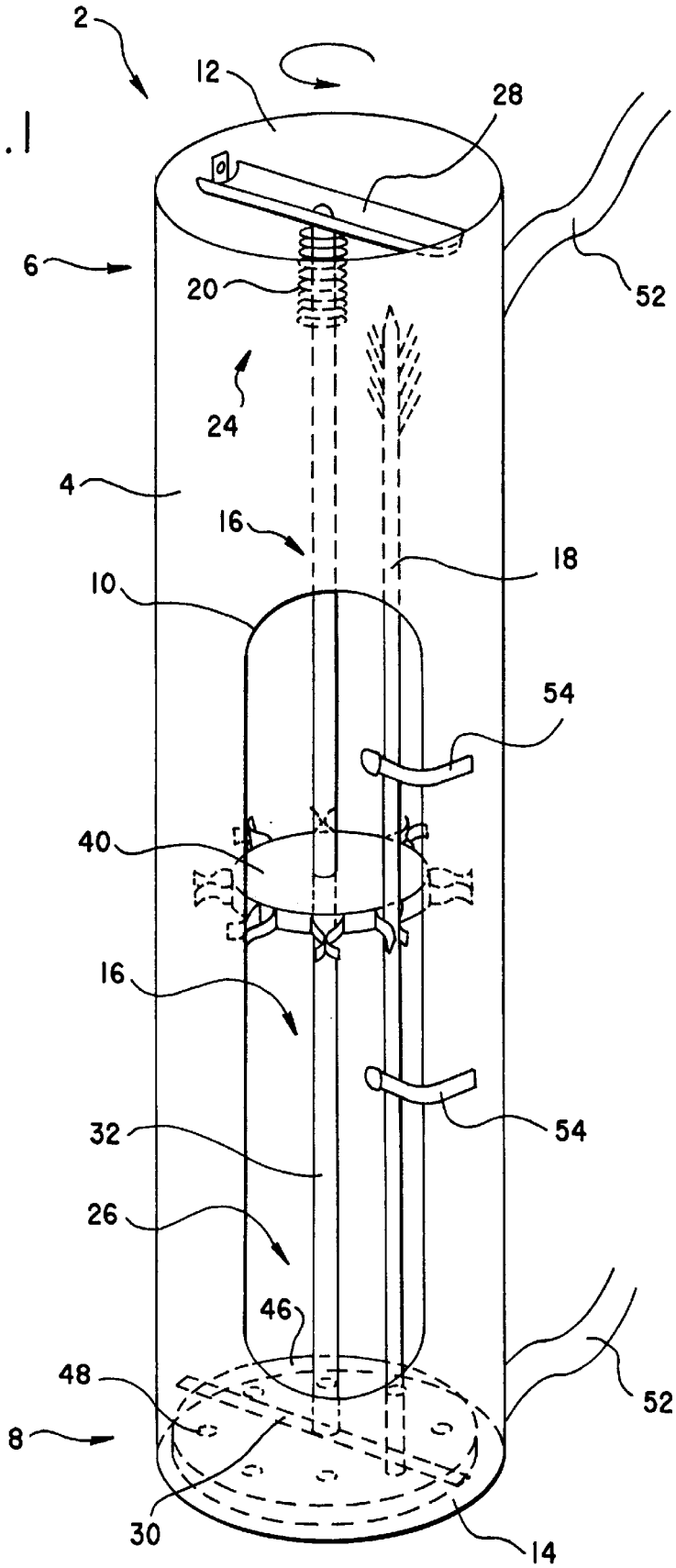
FIG. 1 is a perspective drawing of a first embodiment of the quiver of the present invention.

Referring the drawings, FIG. 1 shows a quiver 2 of a first embodiment of the present invention. The quiver 2 has a housing 4 having a top end 6 and a bottom end 8. In use, of course, the top end 6 of the housing 4 is carried upright. Quiver 2 also has an opening 10 along the length of the housing 4 between the top end 6 and the bottom end 8. The opening 10, as shown in FIG. 1, is a longitudinal opening and large enough so that one wearing the quiver 2 on his or her back can easily remove arrows contained within. The length of the quiver 2 and the length of the opening 10 will depend on the length of the arrow used. The quiver 2 of the first embodiment has an open top 12 and an open bottom 14.

The housing 4 may be made of any lightweight durable material strong enough for outdoor use in a variety of climates, weather conditions and terrains. Preferably, housing 4 is made of a durable plastic polymer, for example, polyvinylchloride (PVC). Other suitable polymers may be used as well. The housing 4 is cylinder-shaped but could be any other shape suitable for the purpose of holding and protecting arrows.

Inside the housing 4 is mounted a carousel 16 which is positioned and arranged inside the housing 4 for the holding and removal arrows 18 by the user. The carousel 16 can move independently of the housing 4. While the carousel 16 may be free spinning or freely rotatable, it is preferable that the carousel 16 be capable of automatically or automatically and incrementally advancing inside the housing 4. The automatic advancement of the carousel 16 is preferably performed by a spring 20, shown in FIG. 1, or alternatively another mechanical means 22 located between the carousel 16 and the housing 4, as show in FIG. 7, such as a bearing assembly capable of winding and unwinding, a ratchet device or a threaded screw device. In FIG. 1, the advancement of carousel 16 is in the counterclockwise direction, as indicated by the arrow. The direction of the advancement can be either clockwise or counterclockwise depending on the construction of quiver 2 as will be further explained.

Referring back to FIG. 1, the carousel 16 has a top end 24 and a bottom end 26. The carousel 16 is mounted in the housing 4 such that the top end 24 is mounted at the top end 6 of the housing 4. A carousel mount 28 may be used to mount the carousel 16 at the top end 6 of the housing 4. The carousel mount 28 is a support bar or bracket attached to the housing 4 at the top end 6 of the housing 4. In the first embodiment of the quiver 2 the carousel 16 is mounted at the bottom end 8 of the housing 4 on a bottom mount 30. The bottom mount 30 is a support bar or bracket attached to the housing 4 providing a connection into which the carousel 16 is fitted. As described later in reference to FIG. 9, the carousel 16 may be mounted at the bottom of the housing 4 without a specific bottom mount 30.

The carousel 16 further comprises a rotatable shaft 32 located along the longitudinal axis of the housing 4. The rotatable shaft 32 rotates along with the entire carousel 16. The rotatable shaft 32 is preferably made of a lightweight, durable, long-lasting material, for example, aluminum. Other materials for use may include metal alloys or plastic.

Figure 2:
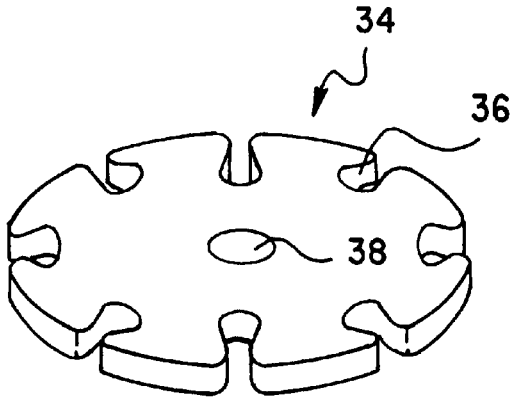
FIG. 2 is a perspective drawing of a device for holding the shafts of arrows in the quiver of the present invention.
Figure 3:
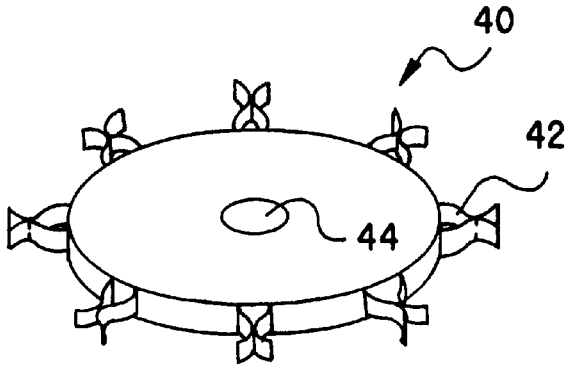
FIG. 3 is a perspective drawing of another device for holding the shafts of arrows in the quiver of the present invention.

Attached along the rotatable shaft 32 is at least one means for gripping or holding arrows 18. In the first embodiment the means for gripping arrows 18 is a clip plate 40 which grips each arrow 18 near the middle of each arrow 18. FIG. 3 shows the clip plate 40 having individual clips 42 equally spaced around the circumference for holding individual arrows 18. The clip plate 40 has a center hole 44 through which the rotatable shaft 32,extends. The clips 40 are preferably made of metal or other resilient material. Another embodiment of the means for gripping arrows 18 is a notched plate 34 which is more clearly shown in FIG. 2 as a round plate having keyhole-shaped notches 36 equally spaced along the circumference and a center hole 38 through which the rotatable shaft 32 extends. The notched plate 34 is preferably made of a pliant, long-lasting material that expands slightly upon the insertion of the arrow 18 into the notch 36 to grip the arrow firmly without slippage. A preferable material is rubber.

Figure 4:
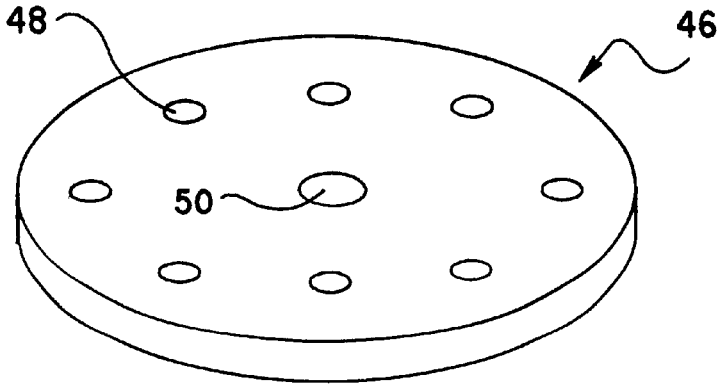
FIG. 4 is a perspective drawing of a device for holding the tips of arrows in the quiver of the present invention.

Also shown as part of the carousel 16 in FIG. 1 is a means for holding the tips of arrows 18 at the bottom end 26 of the carousel 16. The preferable means is a plate 46 having, as shown in FIG. 4, holes 48 for the tips of each arrow 18 held by the clip plate 40 and a center hole 50 through which the rotatable shaft 32 extends. The plate 46 is preferably made of a durable material like plastic. In FIG. 1, arrows 18 are held by clip plate 40 and plate 46 in an orientation substantially parallel to the housing 4.

In use, the carousel 16 of quiver 2 is loaded with 8 arrows 18 and carried on the back of the user by a shoulder strap 52. One arrow 18 adjacent to the opening 10 abuts at least one biasing means like flange 54 which prevents the carousel 16 from movement. Each time the user reaches his or her arm around to the quiver 2, places his or her fingers through the opening 10 onto the arrow 18 adjacent the opening 10, pushes the arrow 18 up so that the tip of the arrow 18 will clear the plate 46 and clear the opening 10, and pulls the arrow 18 forward out through the opening 10, the carousel 16 will advance automatically until another arrow 18 abuts the flange 54, thereby automatically positioning a new arrow 18 adjacent the opening 10 and stopping the motion of the carousel 16. The carousel 16 automatically advances due to the motion of the spring 20 or the other mechanical means 22. The process is repeated until all arrows 18 have been removed from the quiver 2. As will be explained later and shown in FIG. 12, arrows 18 may also be held at an angle with respect to the housing 4. Orienting the arrows 18 at an angle can improve the removal of the arrows 18 from the opening 10 depending on the means used for the advancement of the carousel 16.

Figure 5:
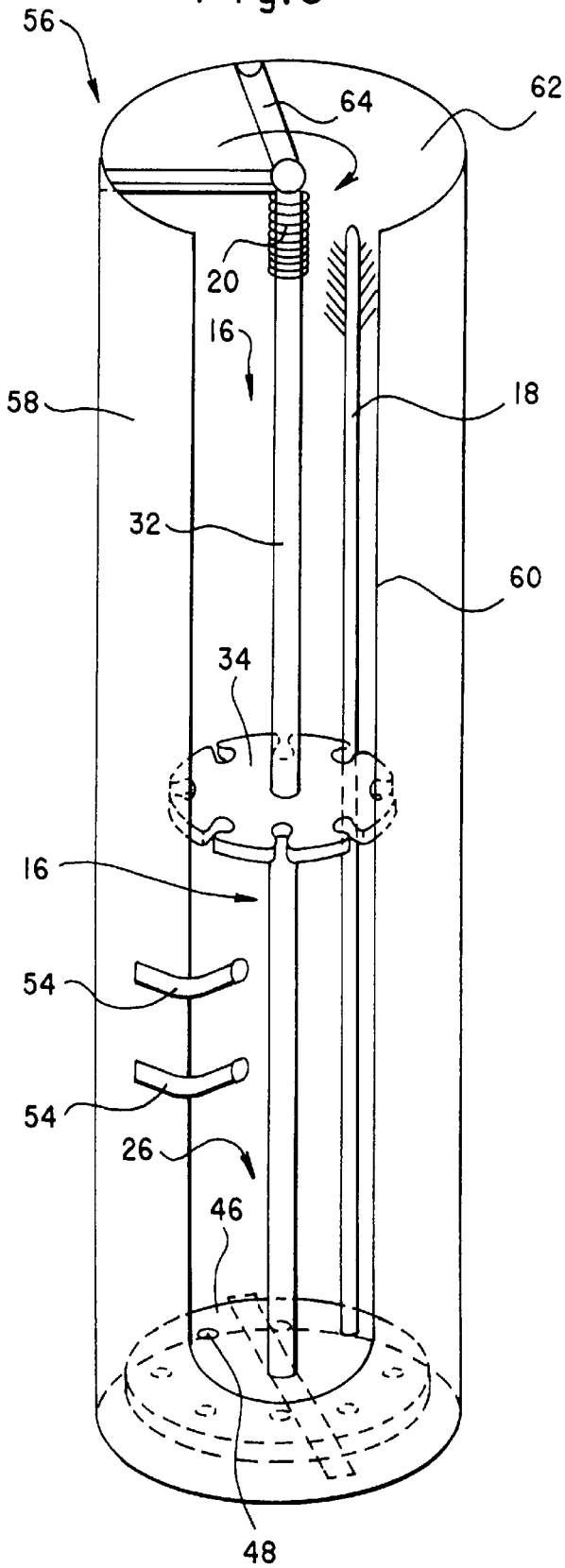
FIG. 5 is a perspective drawing of a quiver of a second embodiment of the present invention.

FIG. 5 illustrates a quiver 56 of a second embodiment. For the remainder of the embodiments, reference numbers that are the same among the different embodiments refer to similar parts. The quiver 56 has a housing 58 and an independently rotatable carousel 16 positioned and arranged therein for the removal of arrows 18 from an opening 60 in housing 58. Carousel 16 advances in the clockwise direction as indicated by the arrow because of flanges 54 which are positioned to abut an arrow 18, traveling in the clockwise direction, so that arrow 18 stops adjacent the opening 60.

The opening 60 is connected to an open top 62. The opening 60 is a longitudinal opening extending along the length of the housing 58. The opening 60 connected to the open top 62 can make the insertion and removal of arrows 18 easier because of the additional space created. In this second embodiment of quiver 56 arrows 18 may be easily loaded from the top end 3 of the housing 58. The rotatable shaft 32 is mounted at the top end 6 of the housing 58 by a carousel mount 64 having an acute angle-shape. This configuration of the carousel mount 64 provides for easy of loading and removal of the arrows 18.

Figure 6:
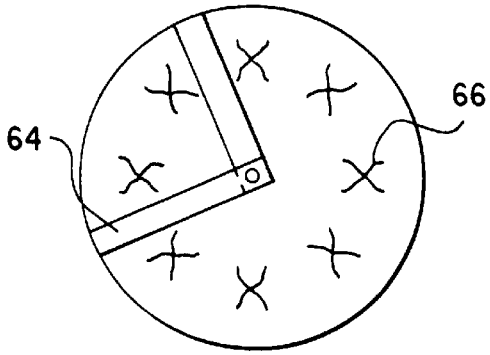
FIG. 6 is a top-down perspective of the quiver of FIG. 5.

FIG. 6 is a top-down view of the quiver 56 of FIG. 5. FIG. 6 illustrates the relative positions of fletched ends 66, depicted as an "X," of arrows 18 and the carousel mount 64.

Figure 7:
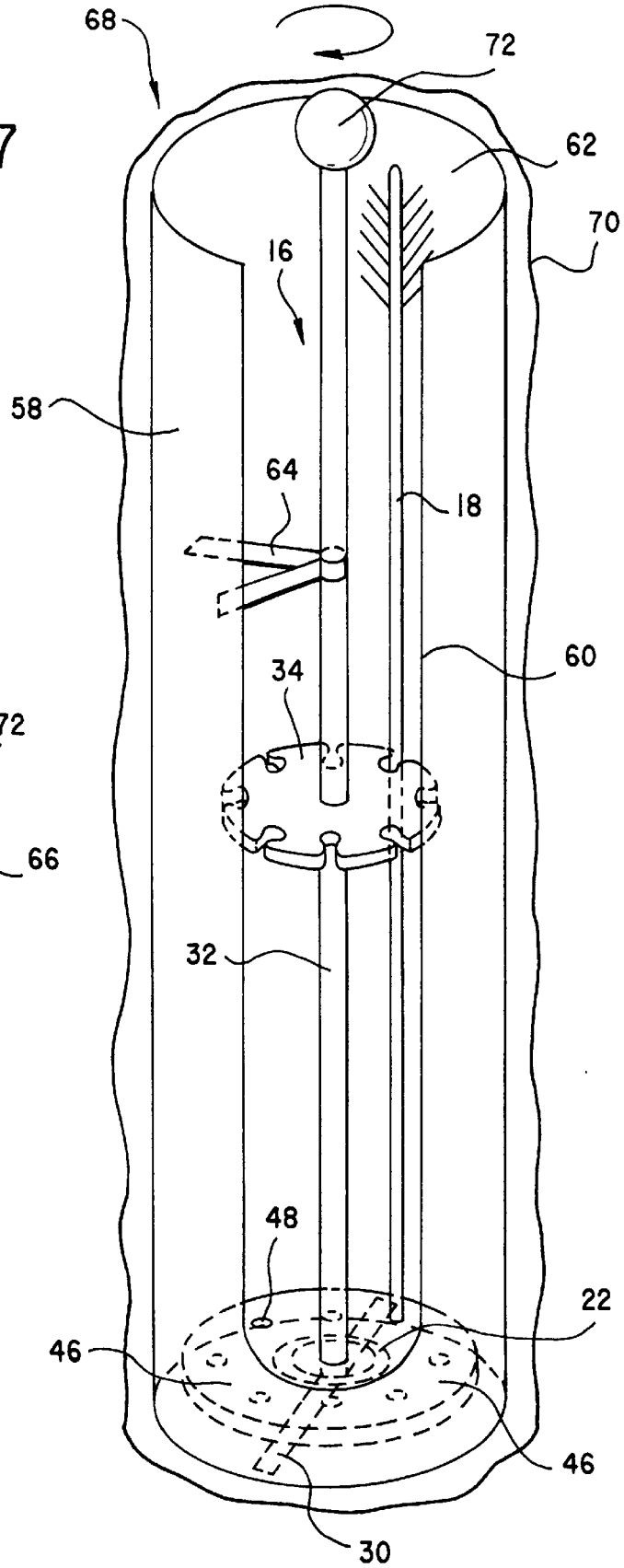
FIG. 7 is a perspective drawing of a quiver of a third embodiment of the present invention.

FIG. 7 shows a quiver 68 of the third embodiment of the present invention. The quiver 68 locates the carousel mount 64 at a position along the top half of the rotatable shaft 32. The carousel mount 64 is located as near to the opening 60 as possible because the carousel mount 64 also serves as a biasing means for arrows 18 like flange 54. In this embodiment, flange 54 is not necessary. In FIG. 7 the carousel 16 moves by the rotating mechanical means 22 located between the bottom of the carousel 16 and the bottom mount 30. Because of the position of the carousel mount 64, the carousel 16 advances in the clockwise direction.

In use the quiver 68 is typically covered by a sheath 70, such as a camouflage nylon sheath, for enclosing at least the open top 64 of the housing 58. So that the tops of the arrows 18 do not contact the sheath 70, the rotatable shaft 32 extends above the height of arrows 18 with a blunt shaft end 72 supporting the sheath 70. The sheath 70 can be used on all embodiments of the quiver of the present invention.

Figure 8:
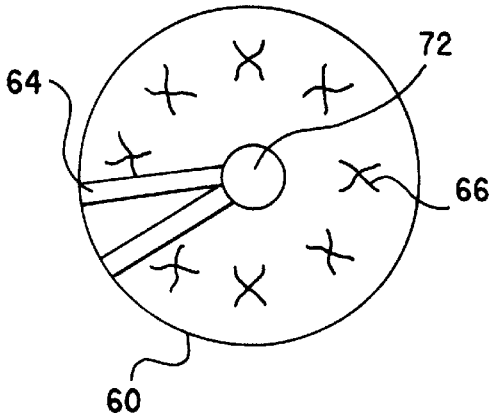
FIG. 8 is a top-down view of the quiver of FIG. 7.

FIG. 8 shows a top-down view of quiver 68 showing the relative positions of the fletched ends 66 of the arrows 18, the carousel mount 64 and the opening 60.

Figure 9:
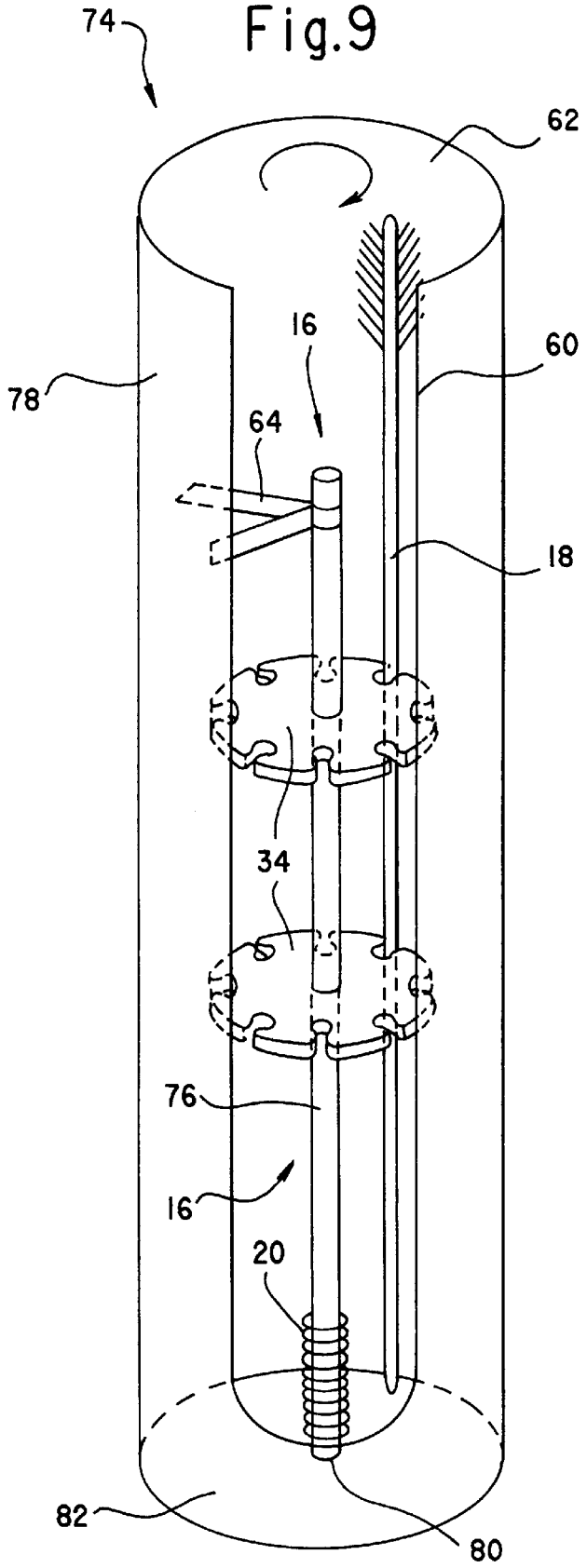
FIG. 9 is a perspective view of a quiver of a fourth embodiment of the present invention.

FIG. 9 illustrates a quiver 74 of a fourth embodiment of the present invention. The quiver 74 has a rotatable shaft 76 located along the longitudinal axis of a housing 78 and which does not extend the fall length of the housing 78. Instead, the rotatable shaft 76 extends about three-quarters of the length of the quiver 74. Further, the carousel 16 is mounted by a mount connection 80 directly on the flat solid bottom 82 of the housing 78. In this embodiment, an independent bottom mount, like bottom mount 30, has been eliminated. The quiver 74 shows two means for gripping arrows 18 being two notched plates 34 along the length of the rotatable shaft 76.

Figure 10:
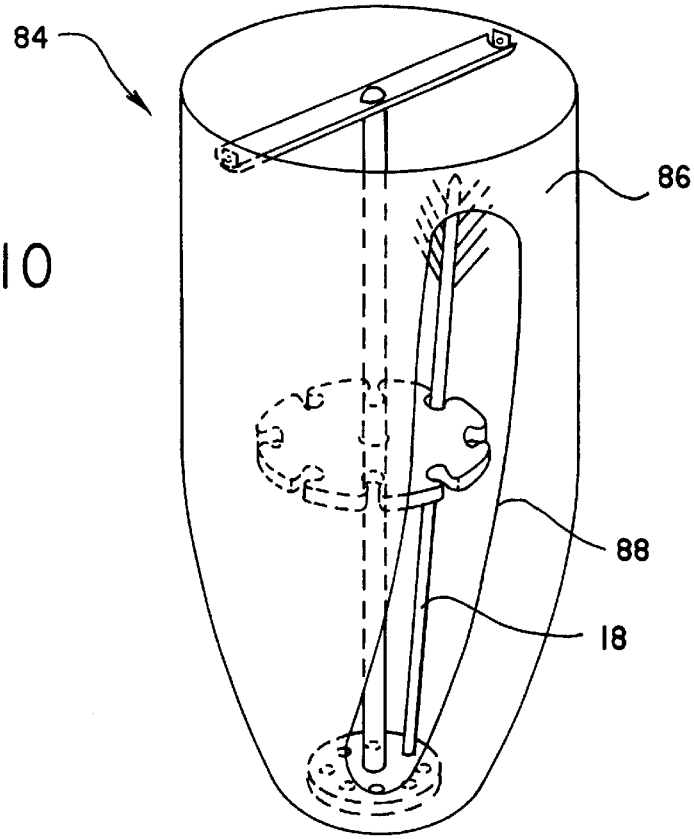
FIG. 10 is a perspective view of a quiver of a fifth embodiment of the present invention.

FIG. 10 illustrates a quiver 84 of a fifth embodiment of the present invention. The quiver 84 has a cone-shaped housing 86 and an angled opening 88 for the insertion and removal of arrows 18. The quiver 84 has an appropriately sized means for gripping the arrows 18, as shown in FIG. 10, along the length of the carousel 16 due to the cone-shaped housing 86. In use, quiver 84 and all other embodiments of the quiver of the present invention operate in a similar manner as described for quiver 2 of the first embodiment.

Figure 11:
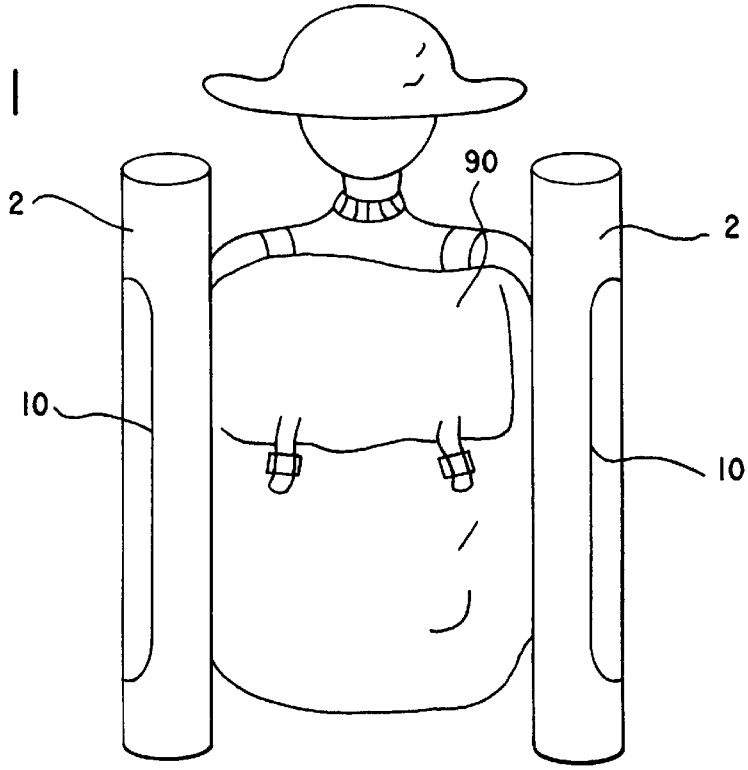
FIG. 11 is a perspective view of a quiver of a sixth embodiment of the present invention.

FIG. 11 illustrates the quiver 2, as shown in FIG. 1, adaptable for attachment to a backpack 90. While quiver 2 may be worn separately by a user with the shoulder strap 52 it may also be attached to the backpack 90, which in FIG. 11 shows the attachment of two quivers 2.

Figure 12:
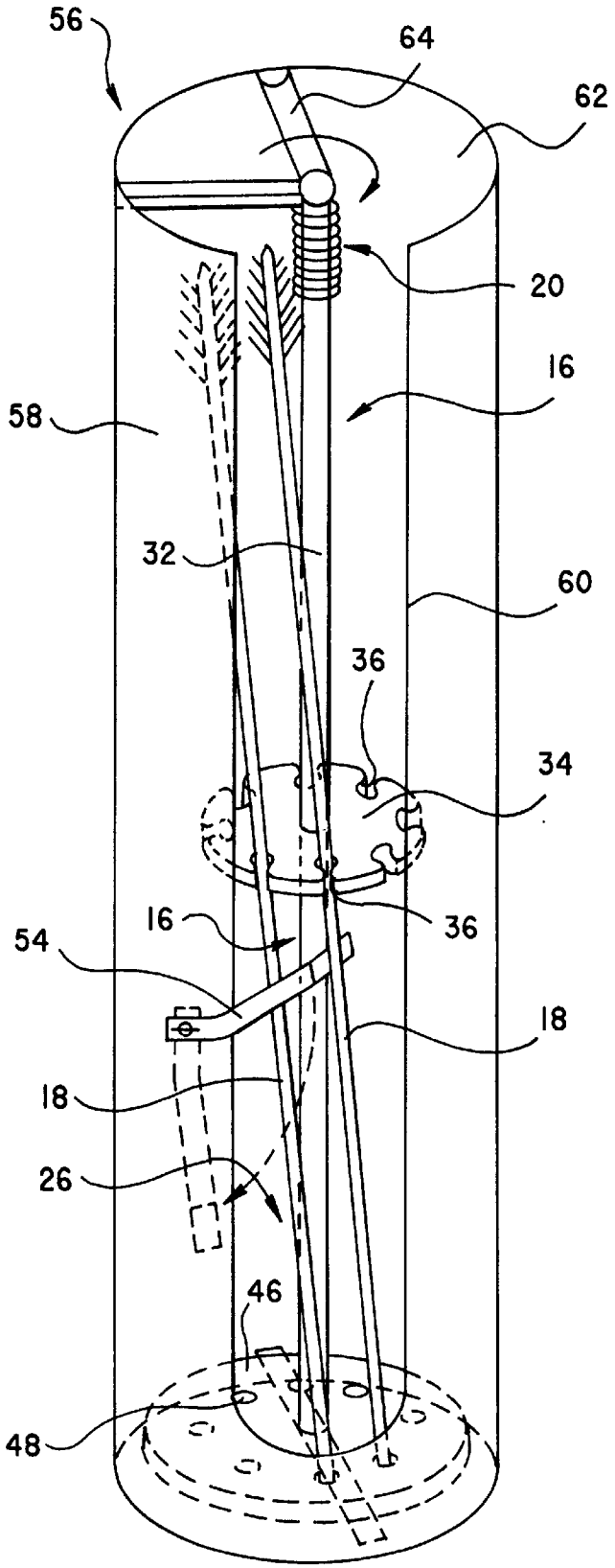
FIG. 12 is a perspective view of a quiver as shown in FIG. 5 with the arrows oriented at an angle.

FIG. 12 illustrates the quiver 56, as show in FIG. 5, with the arrows 18 and correspondingly the flange 54 oriented at an angle with respect to opening 60. If the means for rotating the carousel 16, like spring 20 is strong, then orienting the arrow 18 at an angle may improve the removal of the arrow 18, because during the removal of the arrow 18, if the arrow 18 is not completely clear of the notched plate 34, the plate 46 and the flange 54, then the advancement of the carousel 16 by the spring 20 may cause the arrow 18 to pivot on the flange 54 and change orientation, either from an angled orientation to a vertical orientation or a vertical orientation to an angled orientation, with respect to the opening 60. With the arrow 18 held in an angled orientation, the feathered end being angled toward the flange 54, any advancement of the carousel 16 will cause the arrow 18 to orient vertically and be parallel with the opening 60 for removal from the quiver 56. To hold the arrow 18 in an angled orientation, the keyhole-shaped notches 36 are angled with respect to the notched plate 34 and the holes 48 are angled with respect to the plate 46. FIG. 10 illustrates the same principle except that the arrow 18 is held vertically and the angled opening 88 is angled appropriately.

Referring back to FIG. 12, flange 54 is shown as movable from its position abutting arrow 18 to another position out of the path of rotation of arrow 18. Flange 54 can be fixed or locked in the position for abutting arrow 18 and then released and rotated to a different position, up or down, by the user. The lock and rotation function can be accomplished by attaching flange 54 to housing 58 with a spring and a rod or bolt around which the flange 54 pivots. With a movable flange 54, the user may store previously shot arrows 18 in the quiver 56 by first moving flange 54 out of the path of rotation of arrows 18, manually reversing carousel 16, inserting used arrows 18 into empty keyhold-shaped notches 36, manually advancing carousel 16 until the previously shot arrows are in a position behind the flange 54 and then moving and locking flange 54 in the original position of abutting the next unused arrow 18 to be shot. This way arrows 18 may be retrieved and stored during a hunt. The rotatable flange 54 may be used on the other embodiments of the invention previously described.

While there have been illustrated and described several embodiments of the present invention, it will be apparent that various changes and modifications thereof will occur to those skilled in the art. It is intended in the appended claims to cover all such changes and modifications that fall within the true spirit and scope of the present invention.

I claim:

1. A quiver comprising:

a housing having a top end and a bottom end and an opening between the top and bottom ends for the insertion and removal of arrows, such that the top end of the housing and the opening between the top and bottom ends of the housing are continuous; and a carousel for holding arrows rotatably mounted in the housing, the carousel extending the length of the housing and having a top end and a bottom end;

a carousel mount being a support bracket having an angle shape attached at the top end of the housing and associated with the top and of the carousel;

at least one spring for rotatably biasing the carousel, the at least one spring being associated with said carousel mount and the carousel; and said carousel being positioned and arranged to automatically bring arrows to a position adjacent the opening between the top and bottom ends of the housing for removal from the quiver, whereby the continuous opening in the housing between the top end and the opening between the top and bottom ends and the configuration of the carousel mount provide for ease of loading and removal of arrows.

2. The quiver of claim 1 further comprising, a means associated with the housing against which one arrow on the carousel, closest to the opening between the top and bottom ends of the housing, may be biased.

3. The quiver of claim 1 further comprising, a bottom mount at the bottom end of the housing associated with the bottom end of the carousel.

4. A quiver comprising:

a housing having a top end and a bottom end and an opening between the top and bottom ends for the insertion and removal of arrows;

a rotatable shaft located along the longitudinal axis of the housing;

at least one means attached to the rotatable shaft for gripping arrows in an angled orientation;

a shaft mount associated with the top half of the housing for mounting the shaft;

a rotatable flange associated with the housing against which one arrow, held by the gripping means attached to the rotatable shaft, closest to the opening between the top and bottom ends of the housing, may be biased;

at least one spring for biasing the rotatable shaft, the at least one spring being associated at one end with said shaft mount and at the opposite end with the rotatable shaft; and said rotatable shaft, with said at least one means for gripping arrows, being positioned and arranged to bring arrows automatically to a position adjacent the opening between the top and bottom ends of the housing for removal from the quiver, whereby a user may store previously shot arrows by first moving the rotatable flange out of the path of rotation of the arrows, manually reversing the rotatable shaft, inserting used arrows into the gripping means for arrows, manually advancing the rotatable shaft until the previously shot arrows are in a position behind the rotatable flange and then moving the rotatable flange in a position of abutting a next unused arrow to be shot.

5. The quiver of claim 4 further comprising, a means attached to the rotatable shaft for holding arrow tips.

6. The quiver of claim 4, wherein the shaft mount is located near the top end of the housing and is associated with an end of the rotatable shaft.

7. The quiver of claim 4, further comprising, a bottom mount attached to the bottom end of the housing for mounting an end of the rotatable shaft.

8. The quiver of claim 4 further comprising, a shoulder strap having one end attached to the top end of the housing and the opposite end attached to the bottom end of the housing.

9. The quiver of claim 4, wherein the housing is made of plastic.

10. The quiver of claim 4, wherein the housing is cylindrical.

11. The quiver of claim 4, wherein the housing is cone shaped.

12. The quiver of claim 4, wherein the at least one means attached to the rotatable shaft for gripping arrows, grips arrows in an angled orientation.

* * * * *